US005129794A

United States Patent [19]

Beatty

[11] Patent Number: 5,129,794

[45] Date of Patent: Jul. 14, 1992

[54] PUMP APPARATUS

[75] Inventor: Christopher C. Beatty, Fort Collins, Colo.

[73] Assignee: Hewlett-Packard Company, Palo Alto, Calif.

[21] Appl. No.: 754,172

[22] Filed: Aug. 26, 1991

Related U.S. Application Data

[63] Continuation of Ser. No. 605,883, Oct. 30, 1990, abandoned.

[51] Int. Cl.[5] ..... F04B 17/00

[52] U.S. Cl. ..... 417/413; 417/53; 417/321; 417/322

[58] Field of Search ..... 417/53, 321, 322, 410, 417/413, 474

[56] References Cited

U.S. PATENT DOCUMENTS

| | | | |
|---|---|---|---|
| 3,606,592 | 9/1971 | Madurski et al. | 417/413 |
| 4,411,603 | 10/1983 | Kell | 417/479 |
| 4,636,149 | 1/1987 | Brown | 417/322 |
| 4,821,997 | 4/1989 | Zdeblick . | |
| 4,824,073 | 4/1989 | Zdeblick . | |
| 4,895,500 | 1/1989 | Hök et al. | 417/413 |
| 4,911,616 | 3/1990 | Laumann, Jr. | 417/413 |
| 4,938,742 | 7/1990 | Smits | 222/255 |

*Primary Examiner*—Richard A. Bertsch
*Assistant Examiner*—Charles G. Freay
*Attorney, Agent, or Firm*—Guy J. Kelley

[57] ABSTRACT

A pump apparatus comprising an enclosure for holding a volume of fluid; an intake one-way valve for enabling intake of fluid into the enclosure; a discharge one-way valve for enabling discharge of fluid from the enclosure; a diaphragm for cyclically deflectably increasing and decreasing the volume of the enclosure whereby fluid is oscillatingly drawn into the enclosure and discharged therefrom; a heating assembly for selectively oscillatingly applying heat to the diaphragm and terminating application of heat thereto for selectively oscillatingly deflecting the diaphragm.

9 Claims, 4 Drawing Sheets

PUMP APPARATUS

This is a continuation of copending application Ser. No. 605,883 filed on Oct. 30, 1990, now abandoned.

BACKGROUND OF THE INVENTION

The present invention relates generally to pumps and, more particularly, to a pump having a heat-actuated diaphragm which is formed using microfabrication techniques.

There are many processes in which a relatively small quantity of fluid, either gas or liquid, must be dispensed in a measured amount. One typical process of this type is the process of liquid chromatography in which a precise amount of liquid in a quantity of e.g. 1 microliter must be dispensed to a separation column. In applications in which such small quantities of fluid are to be dispensed by pump, a difficulty in precise metering arises if the pump chamber is relatively large as compared to the quantity of fluid which is to be dispensed. The construction of pumps with extremely small pumping chambers has heretofore proven to be difficult and expensive.

Certain microfabrication techniques for constructing valves are described in U.S. Pat. Nos. 4,821,997 and 4,824,073 of Zdeblick and in U.S. Pat. application Ser. No. 560,933, filed Jul. 31, 1990, of Beatty and Beckmann for Control Valve Using Mechanical Beam Buckling, each of which is hereby specifically incorporated by reference for all that is disclosed therein.

SUMMARY OF THE INVENTION

The present invention is directed to a method of constructing a pump apparatus which may readily employ microfabrication techniques and which may achieve the advantages associated with microfabrication such as batch fabrication, low cost, repeatability and the like. The invention is also directed to a pump apparatus which may have a very small dead volume and which may have a quick response and accurate dispensing characteristics. The pump apparatus may employ a diaphragm which is actuated by oscillatory heating and cooling thereof.

Thus, the invention may comprise a pump apparatus. The pump apparatus has an enclosure for holding a volume of fluid. An intake one-way valve is associated with the enclosure for enabling intake of fluid. A discharge one-way valve is associated with the enclosure for enabling discharge of fluid. A diaphragm is associated with the enclosure for cyclically deflectably increasing and decreasing its volume whereby fluid is cyclically drawn into and expelled from the enclosure. A heating assembly is provided for selectively cyclically applying heat to the diaphragm and terminating application of heat thereto for cyclically deflecting the diaphragm.

The invention may also comprise a method of pumping fluid including: drawing fluid through a first one-way valve into an enclosure by deflecting a diaphragm in a first direction; discharging fluid from the enclosure through a second one-way valve by deflecting the diaphragm in a second direction opposite to the first direction; wherein one of the steps of deflecting the diaphragm in the first direction and deflecting the diaphragm in the second direction comprise the step of expanding the diaphragm by heating it.

The invention may also comprise a method of making a pump including: forming a pair of one-way valves in a first substrate assembly; forming a cavity with an interfacing diaphragm in a second substrate assembly; attaching the first substrate assembly to the second substrate assembly; and attaching an oscillatory heat source to the diaphragm.

The invention may also comprise a method of pumping fluid including: forming a pair of one-way valves in a first substrate assembly; forming a cavity with an interfacing diaphragm in a second substrate assembly; attaching the first substrate assembly to the second substrate assembly; and oscillatingly heating the diaphragm.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENTS

Figure 1:
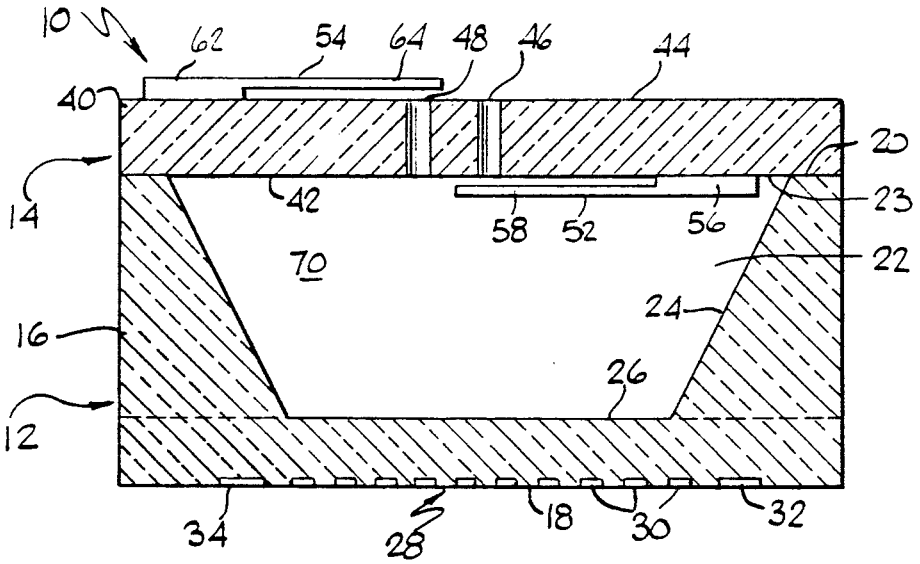
FIG. 1 is a cross sectional elevation view of a pump apparatus.

FIG. 1 illustrates a pump apparatus 10 which includes a first substrate assembly 12 and a second substrate assembly 14. As used herein, "substrate assembly" is meant to include a single substrate member and also a wafer formed from a single substrate member. The first substrate assembly 12 comprises a first substrate member 16 having a first exterior planar surface 18 on one side thereof and a second exterior planar surface 20 on an opposite side thereof. The first substrate member has a cavity 22 provided therein defined by a cavity side wall 24 and bottom wall 26. The cavity has an opening 23 located in the plane of surface 20. A portion of the first member located between the first exterior surface 18 and the bottom wall 26 of the cavity defines a diaphragm 28. A resistor 30 which terminates at terminal pads 32, 34 is embedded in the diaphragm 28 proximate surface 18.

The second substrate assembly 14 comprises a second substrate member 40 having a first planar surface 42 on one side thereof and a second planar surface 44 on an opposite thereof which is parallel to surface 42. First and second holes 46, 48 extend through the second member.

First and second flappers, 52, 54 are associated with the first and second holes in second substrate member 40. The first flapper comprises a generally T-shaped configuration (see FIG. 15) having a branch portion 56 attached to the first surface 42 of substrate member 40 and having a trunk portion 58 positioned in spaced apart, overlying relationship with hole 46. The second flapper comprises a generally T-shaped configuration (see FIG. 14) having a branch portion 62 attached to the second surface 44 of substrate member 40 and having a trunk portion 64 positioned in spaced apart, overlying relationship with hole 48.

As shown in FIG. 1, the second surface 20 of the first substrate member 16 is attached to the first surface 42 of the second substrate member 40 providing a sealed enclosure 70 defined by cavity walls 24, 26 and second substrate member first surface 42. The enclosure 70 which is adapted to hold a volume of fluid 71 therein has only two openings which are provided by holes 46 and 48.

Figure 5:
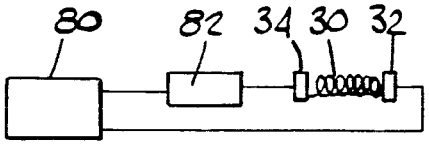
FIG. 5 is a schematic diagram illustrating an assembly for oscillatingly heating a pump diaphragm.

As shown schematically in FIG. 5, the resistor terminal pads 32, 34 are connected to a power source 80, e.g. a 5 volt battery, which provides electrical energy to heat the resistor 30. The battery is connected to the resistor through an oscillator circuit 82, e.g. a CMOS chip, which oscillates the supply of electrical energy provided to the resistor at a predetermined frequency, e.g. one oscillation cycle per millisecond. During each oscillation cycle the resistor heats during a period when energy is supplied thereto and then cools during a period when energy is not supplied thereto.

In use the pump apparatus is connected at surface 44 thereof to a fluid supply line 84 and a fluid discharge line 86, as by conventional conduit attachment means well known in the art. The first hole 46 in substrate member 14 enables fluid communication between the fluid supply line 84 and enclosure 70. The second hole 48 enables fluid communication between the fluid discharge line 86 and enclosure 70.

Figure 2:
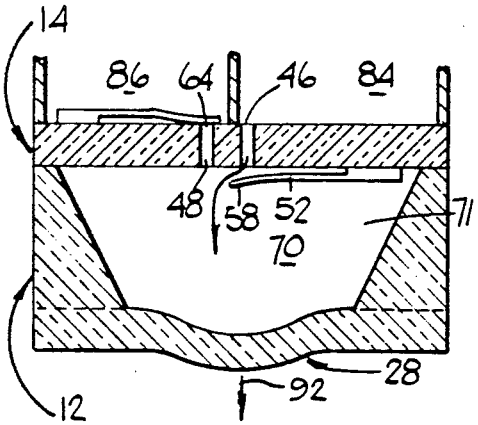
FIG. 2 is a cross sectional elevation view of the pump apparatus of FIG. 1 with the diaphragm thereof moving outwardly during pump intake.

In one embodiment of the invention, which is presently the best mode contemplated, the heating of resistor 30 causes a corresponding heating of diaphragm 28 which causes it to expand and buckle outwardly 92, FIG. 2. As the diaphragm buckles outwardly it causes the volume of enclosure 70 to expand thus drawing fluid into the enclosure through hole 46. As the outward buckling takes place the pressure of fluid in discharge line 86 causes end portion 64 of flapper 54 to be urged into engagement with the second surface 48 of substrate member 14 causing hole 48 to be sealed and thus preventing flow of fluid therethrough.

Figure 3:
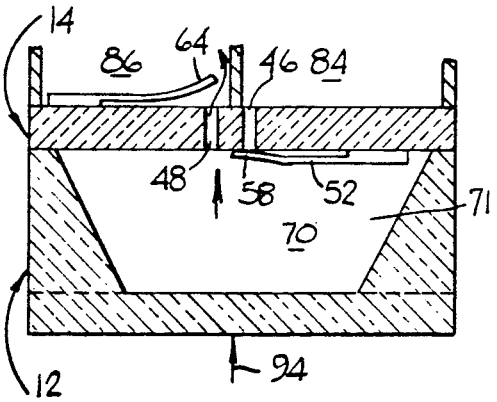
FIG. 3 is a cross sectional elevation view of the pump apparatus of FIG. 1 with the diaphragm thereof moving inwardly during pump discharge.

During a period when resistor 30 and diaphragm 28 are cooling the diaphragm contracts and buckles inwardly 94, FIG. 3, causing a reduction of volume in enclosure 70 with a corresponding pressure increase which causes end portion 58 of flapper 52 to be urged into engagement with surface 28 sealing hole 46. This pressure increase in enclosure 70 also urges flapper 54 away from surface 44 thus opening hole 48 and enabling discharge of fluid from enclosure 70.

Thus in the embodiment of FIGS. 1–3 the resistor heating portion of each oscillation cycle is associated with pump intake and the cooling portion of each oscillation cycle corresponds to pump discharge. Hole 46 and flapper 52 function as a one-way intake valve and hole 48 and flapper 54 function as a one-way discharge valve. The total volume of fluid pumped during a single oscillation cycle may be e.g. 1 nanoliter.

In the embodiment of FIGS. 1–3 the diaphragm at ambient temperature with no external stress applied thereto may have a generally flat profile or may have a profile which is slightly outwardly convex, i.e. bowing away from enclosure 70.

Figure 4:
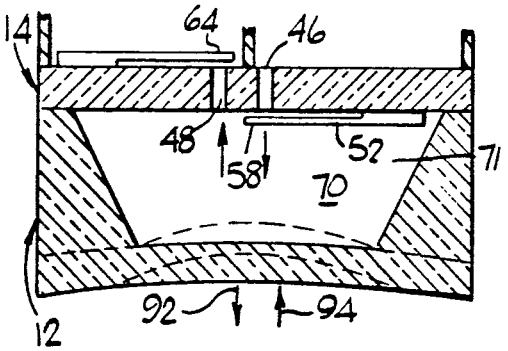
FIG. 4 is a cross sectional elevation view of an alternative embodiment of a pump assembly.

In another embodiment of the invention, as illustrated in FIG. 4, the diaphragm in an ambient temperature unstressed state (solid lines) is inwardly convex, i.e. bows toward enclosure 70. In this embodiment heating of the diaphragm causes it to expand in the direction of enclosure 70, as shown in dashed lines, thus decreasing the volume thereof. Cooling of the diaphragm in this embodiment causes it to return to its original shape thus increasing the volume of the cavity. Thus in the embodiment of FIG. 4 the heating portion of each energy oscillation cycle is associated with pump discharge and the cooling portion of each cycle is associated with pump intake.

Other means of heating the diaphragm to provide oscillatory movement thereof might also be employed such as application of light energy or microwave energy or inductive heat thereto.

A specific method of fabricating a pump apparatus 10 will now be described with reference to FIGS. 6–23.

Figure 6:
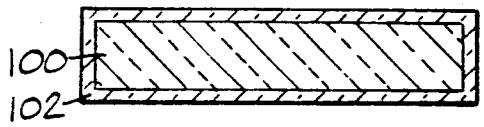
FIGS. 6–13 are cross sectional elevation views illustrating various stages of wafer formation during the fabrication of one portion of the pump assembly shown in FIG. 1.

A substrate member 100 corresponding to substrate member 14 in FIG. 1 is shown in cross section in FIG. 6. Substrate member 100, which may be a silicon substrate member which may be 400 microns thick, is provided with a first coating layer 102, which may be 0.1 microns thick, as by growing an oxide layer thereon, e.g. a silicon dioxide layer. The technique for growing of an oxide layer on a silicon substrate is well known in the art.

Figure 7:
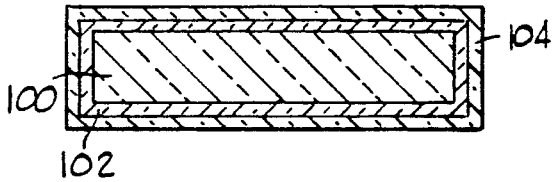

Next a second coating layer 104, e.g. a polysilicon coating is deposited over the first coating by a chemical vapor deposit technique well known in the art, FIG. 7. Coating layer 104 may be 2 microns thick.

Figure 8:
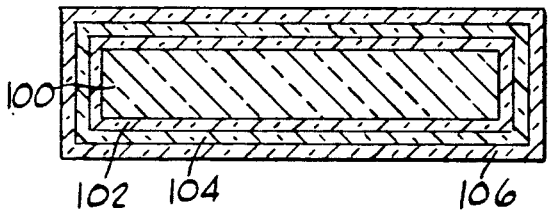
Figure 9:
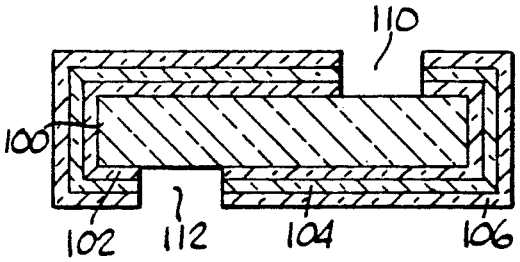

The next step, as illustrated by FIG. 8, is to apply a third coating 106 over the second coating 104. The third coating may be a 0.2 micron thick LPCVD (low pressure chemical vapor deposition) silicon nitride layer which is applied by conventional LPCVD techniques well known in the art.

Next holes 110, 112 extending through the three coating layers 102, 104, 106 are patterned and etched on opposite sides of the substrate assembly. The holes may be etched with carbon tetrafluoride ($CF_4$), FIG. 9.

Figure 10:
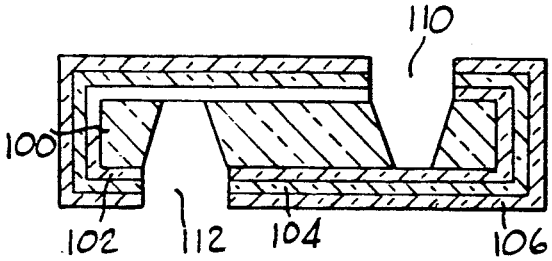

Holes 110, 112 are then extended through the substrate member 100 as by etching with potassium hydroxide/isopropanol/water ($KOH/ISO/H_2O$) as shown in FIG. 10.

Figure 11:
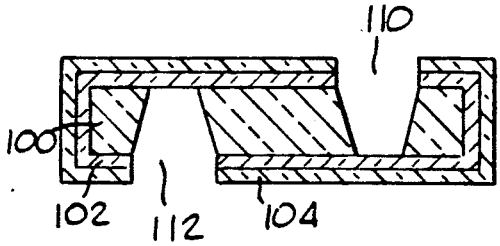

Next, as shown in FIG. 11, the third layer 106 is stripped as by using phosphoric acid ($H_3PO_4$).

Figure 12:
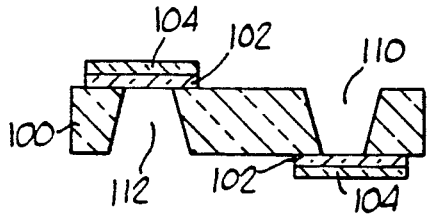
Figure 13:
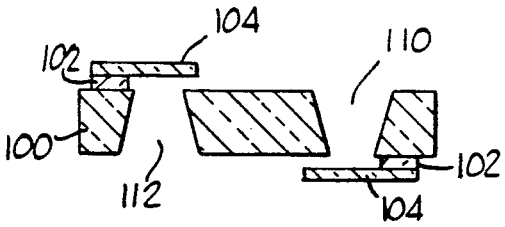
Figure 14:
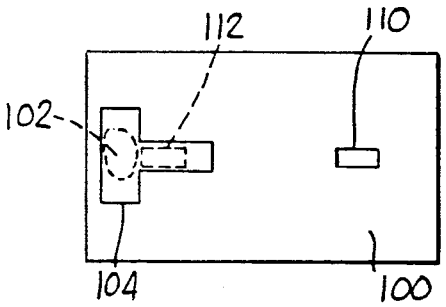
FIG. 14 is a top plan view of the substrate assembly shown in FIG. 13.
Figure 15:
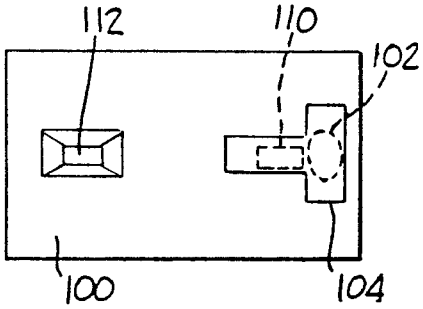
FIG. 15 is a bottom plan view of the substrate assembly shown in FIG. 13.

The portion of the assembly which will become the flappers of the pump apparatus 10 is next patterned and etched as by using $CF_4$. Initially, as shown by FIG. 12, the etching material removes all of the first and second layers 102, 104 except for T-shaped masked portions thereof. As a second phase in this etching operation the etching solution is allowed to remain in contact with the surface of substrate 100 and the perimeter surface of layer 102 thus causing etching of layer 102 to continue, as illustrated in FIGS. 13–15. (FIGS. 14 and 15 are top and bottom plan views, respectively, of FIG. 13.) This perimeter etching of layer 102 causes it to be removed from below the overlying third layer 104 so as to expose holes 110, 112. When this perimeter etching of layer 102 has progressed to the point indicated in FIGS. 13–15 it is terminated by removal of the etching solution thus providing a substrate assembly corresponding to substrate assembly 14 in FIG. 1.

Figure 16:
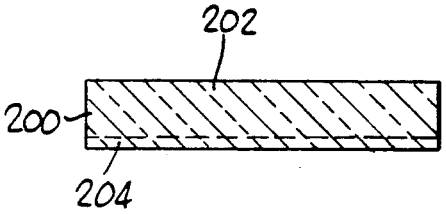
FIGS. 16–21 are cross sectional elevation views illustrating various stages of wafer formation during the fabrication of another portion of the pump assembly shown in FIG. 1.

A substrate member 200 corresponding to substrate member 12 of FIG. 1 is shown in cross section in FIG. 16. Substrate member 200 may be a 400 micron thick silicon substrate having a 385 micron thick heavily doped (e.g. $10^{18}$ atoms/$cm^3$ phosphorous doped) upper portion 202 and a 15 micron thick lightly doped (e.g. $10^{16}$ atoms/$cm^3$ phosphorous doped) lower region 204 which may be provided by a conventional epitaxy process well known in the art.

Figure 17:
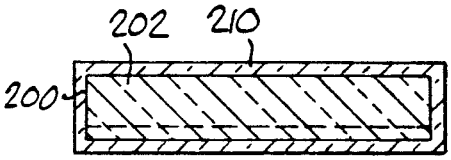

As illustrated in FIG. 17 a first coating layer 210 is applied to the substrate 200 which may be a 0.2 micron thick layer of LPCVD silicon nitride ($Si_3N_4$).

Figure 18:
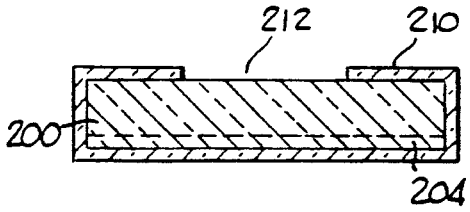

As illustrated by FIG. 18, a hole 212 is patterned and etched in the first layer 210 on the top side of the assembly as by using $CF_4$ plasma.

Figure 19:
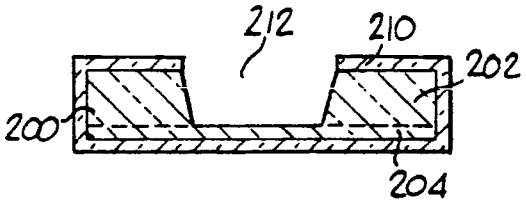

Next, as illustrated in FIG. 19, hole 212 is extended through the first portion 202 of the substrate 200 so as to provide a cavity 214 therein as by etching the exposed surface thereof with a 1:3:8 solution of hydrofluoric acid, nitric acid and acetic acid.

Figure 20:
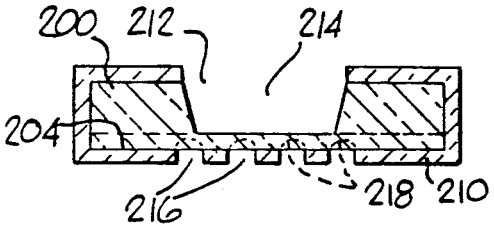

A snaking pattern 216, corresponding in shape to electrical element 30, 32, 34 in FIG. 1, is then etched in the first layer 210 on the bottom side of the assembly as by using $CF_4$, as illustrated in FIG. 20.

Next, as illustrated in dashed lines in FIG. 20, resistors 218 e.g. phosphorus resistors are implanted in the lightly doped portion 204 of the substrate in the surface thereof exposed by the snaking pattern etched in layer 210. This resistor implant may be performed using the technique of ion implantation which is well known in the art. The resistor pattern provided may have a resistance of e.g. 1000 ohms.

Figure 21:
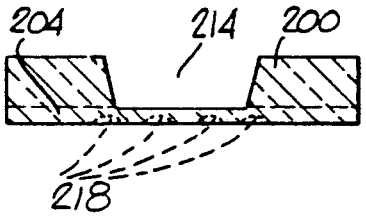

Next, as illustrated by FIG. 21, the remaining portion of coating layer 210 is stripped away as by using $H_3PO_4$.

Figure 22:
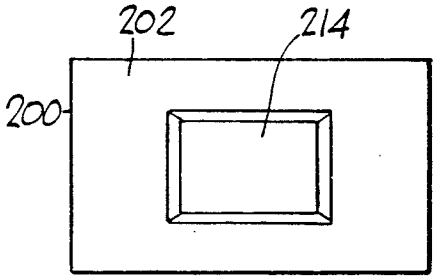
FIG. 22 is a top plan view of the substrate assembly shown in FIG. 21.
Figure 23:
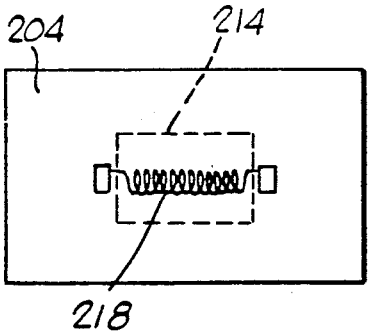
FIG. 23 is a bottom plan view of the substrate assembly shown in FIG. 21.

FIGS. 22 and 23 are top and bottom plan view of FIG. 21 showing the cavity 214 and resistor 218 configurations provided in substrate 200.

The top surface of substrate 200 shown in FIG. 22 is then positioned in contact with the bottom surface of substrate 100 shown in FIG. 15 and the two substrates are bonded together as by silicon-silicon fusion bonding, which is well known in the art, so as to provide a pump assembly 10 such as shown in FIG. 1.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A pump apparatus comprising:

enclosure means for holding a volume of fluid, said enclosure means comprising a pump body defining a pump body cavity, said pump body being formed from a first substrate assembly having a first surface defining an exterior portion of said diaphragm means and a second surface defining an opening of said pump body cavity;

intake one-way valve means operatively associated with said enclosure means for enabling intake of fluid into said enclosure means;

discharge one-way valve means operatively associated with said enclosure means for enabling discharge of fluid from said enclosure means;

diaphragm means operatively associated with said enclosure means for cyclically deflectably increasing and decreasing said volume of said enclosure means whereby fluid is cyclically drawn into said enclosure means ad discharged therefrom, wherein said diaphragm means interfaces with said pump body cavity at an internal surface portion of said first substrate assembly;

heating means operatively associated with said diaphragm means for selectively cyclically applying heat to said diaphragm means and terminating application of heat thereto for selectively cyclically deflecting said diaphragm means;

second substrate assembly attached to said second surface of said first substrate assembly in overlying relationship with said cavity opening, wherein said second substrate assembly comprises a first surface attached to said second surface of said first substrate assembly and a second surface positioned parallel to said first surface of said second substrate assembly; and wherein said intake one-way valve means comprises:

a first hole extending between said first and second surfaces of said second substrate member; and a first flapper having a first end attached to said first surface of said second substrate assembly and a second end positioned over said first hole in said second substrate assembly in displaceable relationship therewith.

2. The invention of claim 1 wherein said discharge one-way valve means comprises:

a second hole extending between aid first and second surfaces of said second substrate assembly; and a second flapper having a first end attached to said second surface of said second substrate assembly and a second end positioned over said second hole in said second substrate assembly in displaceable relationship therewith.

3. A method of making a pump comprising:

forming a pair of one-way valves in a first substrate assembly;

forming a cavity with an interfacing diaphragm in a second substrate assembly;

attaching said first substrate assembly to said second substrate assembly;

attaching a cyclic heat source to the diaphragm;

wherein the step of forming a pair of one-way valves comprises the steps of:

forming a first hole through the first substrate assembly;

forming a first flapper having a deflectable free end disposed in alignment with the hole which is flexible displaceable into sealing relationship with the hole.

4. A method of pumping fluid comprising:

forming a pair of one-way valves in a first substrate assembly;

forming a cavity with an interfacing diaphragm in a second substrate assembly;

attaching said first substrate assembly to said second substrate assembly;

cyclically heating the diaphragm;

wherein the step of forming a pair of one-way valves comprises the steps of:

forming a first hole through the first substrate assembly;

forming a first flapper having a deflectable free end disposed in alignment with the hole which is flexibly displaceable into sealing relationship with the hole.

5. A method of making a pump comprising:

forming a pair of one-way valves in a first substrate assembly;

forming a cavity with an interfacing diaphragm in a second substrate assembly, said diaphragm being implanted with a continuous pattern of electrically conductive resistor material through the use of microfabrication techniques;

attaching said first substrate assembly to said second substrate assembly;

attaching a cyclic heat source to the resistor pattern provided in the diaphragm;

wherein the step of forming a pair of one-way valves comprises the steps of:

forming a first hole through the first substrate assembly;

forming a first flapper having a deflectable free end disposed in alignment with the hole which is flexibly displaceable into sealing relationship with the hole.

6. A pump apparatus comprising:

enclosure means for holding a volume of fluid;

intake one-way valve means operatively associated with said enclosure means for enabling intake of fluid into said enclosure means;

discharge one-way valve means operatively associated with said enclosure means for enabling discharge of fluid from said enclosure means;

diaphragm means operatively associated with said enclosure means for cyclically deflectably increasing and decreasing said volume of said enclosure means whereby fluid is cyclically drawn into said enclosure means and discharged therefrom, said diaphragm means being formed by microfabrication techniques from a unitary wafer comprising a substrate layer and at least one coating layer;

heating means operatively associated with said microfabricated diaphragm means for selectively cyclically applying heat to said diaphragm means and terminating application of heat thereto for selectively cyclically deflecting said diaphragm means wherein said heating means comprises resistor means integrally formed with said diaphragm means by microfabrication techniques for heating said diaphragm means in response to an electrical current passed therethrough.

7. The invention of claim 6 wherein said microfabricated diaphragm means consists of a portion of a single layer of said unitary wafer.

8. The invention of claim 7 wherein said diaphragm means consists of a portion of said substrate layer of said unitary wafer.

9. A method of pumping fluid comprising:

a) providing a substrate layer which is adapted to form a first layer of an integral wafer;

b) applying at least one coating layer to said first substrate member to provide at least a second layer of said integral wafer;

c) employing microfabrication techniques to expose opposite surface portions of a single one of said at least two layers of said integral wafer so as to create a pump diaphragm having an integrally formed resistor pattern therein from said single one of said layers in the portion thereof having said opposite exposed surface portions;

d) cyclically heating said pump diaphragm formed from said single layer of said wafer by microfabrication techniques by passing electrical current through said internally formed resistor pattern so as to expand and contract said pump diaphragm to pump fluid through an associated pump chamber.

* * * * *

UNITED STATES PATENT AND TRADEMARK OFFICE

CERTIFICATE OF CORRECTION

PATENT NO. : 5,129,794

DATED : July 14, 1992

INVENTOR(S) : Christopher C. Beatty

It is certified that error appears in the above-identified patent and that said Letters Patent is hereby corrected as shown below:

Column 8, line 37, "internally" should read --integrally--;

Column 6, line 38, "aid" should read --said--.

Signed and Sealed this

Seventeenth Day of August, 1993

*Attest:*

*Attesting Officer*

BRUCE LEHMAN

*Commissioner of Patents and Trademarks*